US005809917A

United States Patent [19]

McGowan et al.

[11] Patent Number: 5,809,917

[45] Date of Patent: Sep. 22, 1998

[54] SYSTEM FOR CONTROLLING TENSION OF A PRIMARY BACKING MATERIAL IN A TUFTING MACHINE

[75] Inventors: O. W. McGowan, LaGrange; David H. Gustashaw, Pine Mountain, both of Ga.; Shawn L. Wheeler, Opelika, Ala.; James T. Channell; Daniel H. Daley, both of LaGrange, Ga.

[73] Assignee: Interface, Inc., Atlanta, Ga.

[21] Appl. No.: 783,663

[22] Filed: Jan. 15, 1997

[51] Int. Cl.[6] ..... D05B 15/14

[52] U.S. Cl. ..... 112/80.32; 112/322

[58] Field of Search ..... 112/80.3, 80.32, 112/80.01, 307, 322, 220; 242/418.1

[56] References Cited

U.S. PATENT DOCUMENTS

| | | | |
|---|---|---|---|
| 2,818,037 | 12/1957 | McNutt . | |
| 2,840,019 | 6/1958 | Beasley . | |
| 2,932,181 | 4/1960 | MacCaffray, Jr. . | |
| 3,059,598 | 10/1962 | Wade | 112/80.3 |
| 3,091,199 | 5/1963 | Ballard | 112/80.32 |
| 3,842,767 | 10/1974 | Short | 112/80.32 |
| 3,865,059 | 2/1975 | Jackson | 112/80.32 |
| 4,267,787 | 5/1981 | Fukuda . | |
| 4,384,538 | 5/1983 | Slattery . | |
| 4,430,870 | 2/1984 | Winter et al. . | |
| 4,445,447 | 5/1984 | Bardsley et al. . | |
| 4,519,332 | 5/1985 | Fukuda . | |
| 4,682,554 | 7/1987 | Goto et al. . | |
| 4,722,288 | 2/1988 | Nomura et al. . | |
| 4,738,209 | 4/1988 | Yanagi et al. . | |
| 4,829,917 | 5/1989 | Morgante et al. . | |
| 4,867,080 | 9/1989 | Taylor et al. . | |
| 4,981,091 | 1/1991 | Taylor et al. . | |
| 5,005,498 | 4/1991 | Taylor et al. . | |
| 5,224,434 | 7/1993 | Card et al. . | |
| 5,383,415 | 1/1995 | Padgett, III . | |
| 5,392,723 | 2/1995 | Kaju . | |
| 5,461,996 | 10/1995 | Kaju . | |
| 5,480,085 | 1/1996 | Smithe et al. | 242/418.1 X |
| 5,509,364 | 4/1996 | Bardsley . | |
| 5,526,760 | 6/1996 | Ok . | |
| 5,562,056 | 10/1996 | Christman, Jr. . | |
| B1 4,981,091 | 3/1995 | Taylor et al. . | |

*Primary Examiner*—Peter Nerbun
*Attorney, Agent, or Firm*—John S. Pratt; Kilpatrick Stockton LLP

[57] ABSTRACT

A system for controlling tension improves carpet quality by maintaining tension along a primary backing material at a constant value. The system controls the tension by maintaining the speed of an entry pin roller slightly slower than the speed of an exit pin roller. The exit pin roller is driven with a main drive motor while the entry pin roller is independently driven by a separate vector drive motor. An encoder, coupled to the exit pin roller, is driven in synchronism with the exit pin roller and produces a pulsed output which is converted into an analog signal representative of the speed of the exit pin roller. A controller receives a user-defined desired value of tension and monitors outputs of a pair of load cells to determine the amount of tension actually on the primary backing material. Based on the difference between the actual value of tension and the desired value of tension, the controller produces a control signal which is fed to a drive circuit. The drive circuit drives the vector motor and, consequently, the entry pin roller at a speed dictated by the analog signal representing the speed of the exit pin roller and the control signal generated by the controller. The quality of the carpet produced by the tufting machine is improved since the stitch density and the carpet pattern may remain substantially constant whereby variations in patterns can be minimized.

14 Claims, 2 Drawing Sheets

SYSTEM FOR CONTROLLING TENSION OF A PRIMARY BACKING MATERIAL IN A TUFTING MACHINE

FIELD OF THE INVENTION

This invention relates to a system for controlling tension of a material and, more particularly, to a system for controlling the tension of a primary backing material as the backing material is passed through a tufting machine.

BACKGROUND OF THE INVENTION

A tufting machine, such as a carpet tufting machine, has a pair of pin rollers which are driven to feed a primary backing material off of a large storage roll and over a bedrail. The two pin rollers are disposed on opposite sides of the bedrail whereby the first pin roller introduces the primary backing material into the tufting machine and the second pin roller removes the backing material from the tufting machine. A set of needles are located above the bedrail across the width of the tufting machine and are threaded with yarns. The needles are reciprocated through the action of a needle bar so as to insert the yarns through the primary backing material to form tufts in the primary backing material. The tufting machine may have various combinations of loopers and/or knives to enable making either loop-pile or cut-pile carpet. Based on the arrangement of threaded needles, loopers, and knives and based on the color of the yarns, the tufting machine can generate various patterns of carpet. To permit further variations in carpet patterns, some tufting machines are equipped with needle bars that can slide across the width of the tufting machine. The backing material with tufted yarns is typically moved to a separate machine for applying a secondary backing which secures the tufted yarns to the primary backing material.

In a conventional tufting machine, the second pin roller, or exit pin roller, is driven off of a main drive shaft by a pulley and belt arrangement and the first pin roller, or entry pin roller, is driven off of the exit pin roller by a belt and pulley arrangement. The exit pin roller is driven at a slightly faster speed so as to produce tension across the primary backing material and to ensure that the primary backing material is continuously advanced over the bedrail. In addition to the pin rollers, all other parts of a conventional tufting machine, such as the needle bar and loopers, are driven off of the main drive shaft.

A problem with the conventional tufting machine is that the tension along the length of the primary backing material in the direction of travel varies during the operation of the machine. The tension in the primary backing material naturally varies during operation of the tufting machine based on the weight of the backing material that is present on a roll of backing material at any particular moment in time. As the backing material is fed off of the roll during the production of the carpet, the tension across the primary backing material gradually decreases due to a smaller weight of backing material on the roll and thus a smaller force resisting the rotation of the entry pin roller. The tension may also vary with the type of primary backing material and may even vary along a length of primary backing material due to imperfections in the material.

A change in the tension along the primary backing material can have a significant impact on the quality and cost of the carpet that is produced by the tufting machine. For instance, a variation in the tension will result in a corresponding variation in the number of stitches per inch and, consequently, a variation in the density of the tufted carpet.

Since the yarns are one of the most expensive components of the carpet, the stitch density should be maintained as close as possible to the desired density and any increase above this desired density will increase the cost of producing the carpet and thus lower the profitability. To maximize profit, the tension in the primary backing material should therefore remain relatively constant.

Because the density of the tufted carpet is affected by the tension of the primary backing material, the resultant pattern produced by the tufting machine will also change with the tension. The carpet pattern formed at the beginning of a roll of primary backing material may be noticeably different from the pattern that is produced near the end of the roll of primary backing material since the patterns may be formed at different tension levels and thus at different stitch densities. These variations in pattern can be especially problematic in the production of carpet tiles since carpet tiles cut from one location along the roll, such as the beginning of the primary backing material roll, are often placed adjacent to carpet tiles cut from a different location along the roll, such as the opposite end of the primary backing material roll. In view of the differing patterns in carpet tiles along the length of backing material due to tension variations, the pattern of the carpet may become staggered or otherwise disrupted between adjacent tiles. It is therefore a problem in the production of carpet tiles, as well as generally with broadloom carpets, to maintain a constant pattern despite variations in tension in the primary backing material.

In addition to pattern variations, the tension in the primary backing material may cause other problems in the resultant carpet. For instance, the tension in the primary backing material can become excessively high during the production of the carpet. When the tension is too high, the primary backing material loses its elasticity and will not rebound but rather remains in a deformed lengthened state. The carpet produced using these lengthened portions of the primary backing material will have a different density of stitches than the other portions of the primary backing material which will consequently result in pattern variations. The difference in stitch density can be most noticeable between portions of carpet where the primary backing material springs back to its initial length and portions of carpet where the primary backing material is deformed to remain lengthened. This discrepancy between carpet portions, in addition to producing differences in stitch densities, will also produce variations in the pattern and a possible staggering of the pattern.

In summary, changes in tension in the primary backing material result in inconsistent carpet appearance and quality. The tension of the primary backing material affects the number of stitches per inch and thus affects the density of the carpet. As a result, tension variations can cause pattern variations and can cause the carpet to become deformed, both of which are a concern in manufacturing acceptable carpet.

To counteract the effects of the weight of the primary backing roll on the tension of the primary backing material, a manually actuated brake can be placed on the primary backing roll. As the primary backing material is being removed from the roll, an operator manually increases the force applied by the brake so as to approximate a constant resistive force to the entry pin roller. Although the use of a brake may reduce to some extent the range of variation in tension, the use of the brake does not result in the application of a constant tension along the primary backing material. The operator often cannot spend his or her entire time at the brake and thus cannot maintain the tension at a constant level throughout the operation of the tufting machine.

Instead, the operator periodically returns to the brake to adjust its setting. The operator at these periodic times, moreover, cannot adjust the brake so that the tension is repeatedly set to the same exact level since the physical limitations of the operator and the non-linear operation of the brake undoubtedly cause some error in the amount of force applied by the brake. Further, with the brake, an operator attempts to maintain the tension along the primary backing material at its initial level, which is the highest amount of tension. The brake therefore does not adequately alleviate the problems with the tension being too high.

SUMMARY OF THE INVENTION

The present invention solves the primary backing tension problems of the prior art in a method of advancing backing through a tufting machine, and apparatus for doing so, that is continuously measuring and controlling tension. The tufting machine of this invention includes a pair of advancing rollers for moving the backing material through the tufting machine and a force measuring unit for measuring a tension generated along the backing material between the advancing rollers. A drive motor rotates one of the advancing rollers and a monitoring unit monitors a condition, preferably speed, of the other advancing roller. A controller receives the measured value of tension from the measuring unit and compares it to a predefined desired value of tension. Based on the difference between the measured amount of tension and the predefined value of tension, the controller generates a control signal which is supplied to a drive circuit. The drive circuit receives outputs from the controller and the monitoring unit and controls the drive motor and the rotation of the one advancing roller to cause the actual value of tension measured along the length of the backing material to become substantially equal to the predefined desired value of tension.

It is thus an object of the present invention to maintain a constant tension along the length of primary backing material as the material is fed through a tufting machine.

It is a another object of the present invention to automatically adjust the tension along the length of the backing material in response to changes in the weight of a roll dispensing the material or in response to other forces at work which affect the tension in the material.

It is yet a further object of the present invention to reduce variations in a pattern produced along a length of carpet.

It is an additional object of the present invention to maintain control over a density of stitches in a carpet.

Other objects, features, and advantages will become apparent with reference to the remainder of this document.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION

Figure 1:
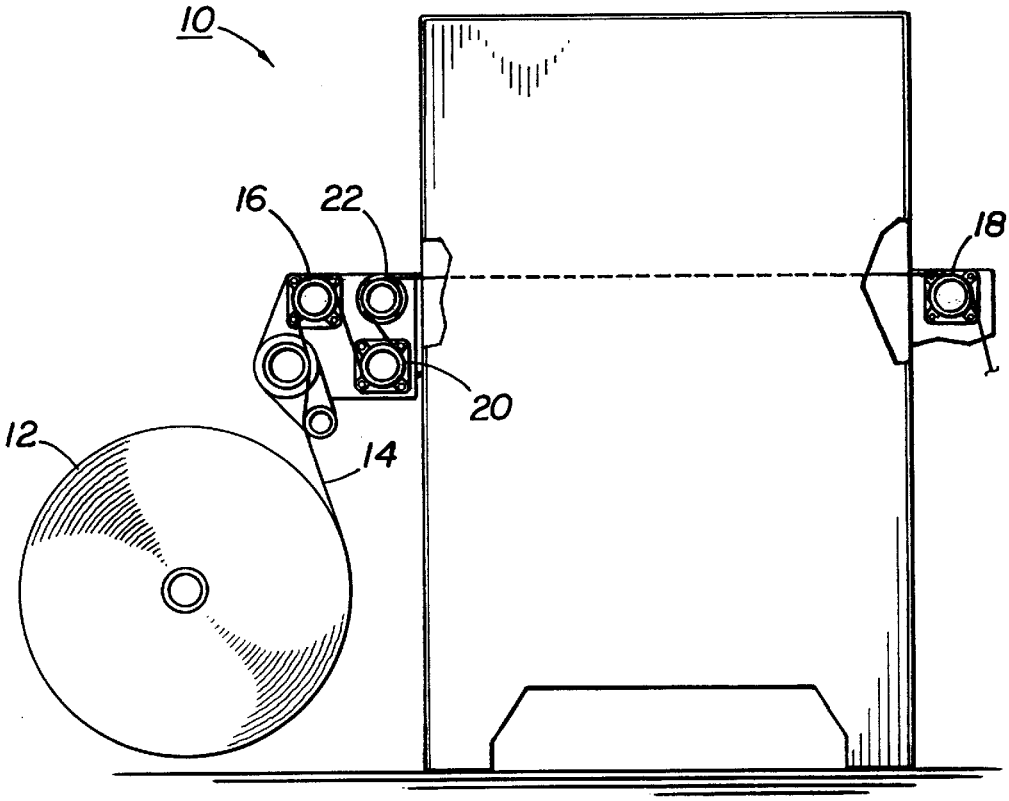
FIG. 1 is a partial end view of a tufting machine according to a preferred embodiment of the invention illustrating a path of travel for a primary backing material.

With reference to FIG. 1, a tufting machine 10 according to a preferred embodiment of the invention comprises an entry pin roller 16 and an exit pin roller 18 for advancing a primary backing material 14 through the tufting machine 10 and across a bedrail. The primary backing material 14 is fed off of a roll 12 and travels partially around an idler roller 20 and a load cell roller 22 before entering the tufting machine 10. Within the tufting machine 10, needles located above the bedrail are reciprocated to insert yarns through the primary backing material 14 to form tufts in the primary backing material 14. The tufting machine 10 may include loopers for holding certain ones of the tufts to form looped-pile carpet or may include knives for cutting certain ones of the tufts to produce cut-pile carpet. The needles may be selectively threaded with different yarns to produce patterned carpet and, moreover, may be mounted on a sliding needle bar to enable variations in the patterns produced in the carpet. The needles, needle bar, loopers, knives and other devices or mechanisms for forming tufts in the primary backing material are well known devices.

Figure 2:
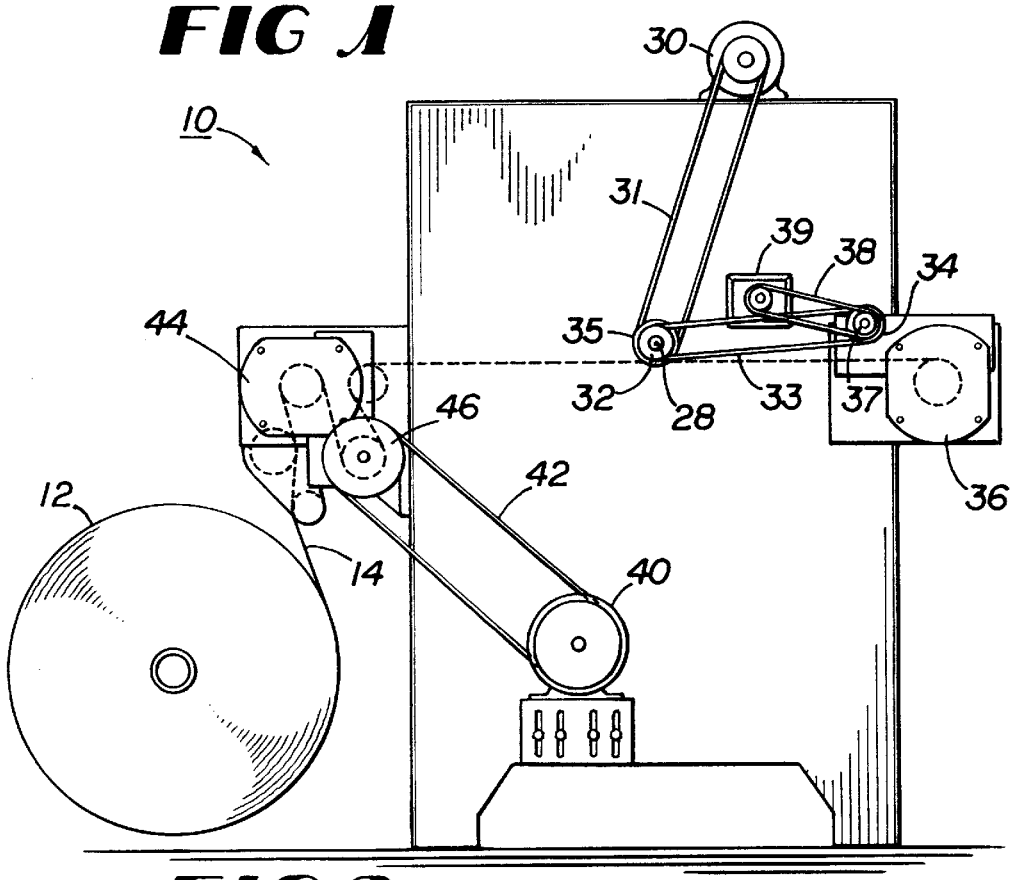
FIG. 2 is an end view of the tufting machine of FIG. I illustrating various drive motors and pulleys in the tufting machine.

In the tufting machine 10, the entry pin roller 16 is driven independently from the exit pin roller 18. With reference to FIG. 2, a drive motor 30 is coupled to a main drive shaft 28 of the tufting machine 10 through a belt 31 and pulley 35. The main drive shaft 28, as is typical in the art, is used to drive numerous other components of the tufting machine 10, such as the needle bar, any loopers in the machine 10, as well as any rocker bars and associated knives in the tufting machine 10. The drive shaft 28 additionally drives the exit pin roller 18 and thus controls the speed of the exit pin roller 18. As shown in FIG. 2, the drive shaft 28 is coupled to a gearbox 36 through pulleys 32 and 34 and belt 33. The pulley 34 and gearbox 36 transfer rotational forces from the main drive shaft 28 to the exit pin roller 18 in a known manner to cause the exit pin roller 18 to rotate and to remove the primary backing material 14 from the tufting machine 10.

Whereas the entry pin roller 16 in a conventional tufting machine would also be driven from the motor 30 and the main drive shaft 28, the tufting machine 10 according to the invention drives the entry pin roller 16 with a separate motor 40. The motor 40, with reference to FIGS. 2 and 3, transfers rotational forces to a gearbox 44 through pulleys 41 and 46 and belt 42. The gearbox 44 is connected to the entry pin roller 16 in a known manner to cause the entry pin roller 16 to rotate and to introduce the primary backing material 14 off of the roll 12 and into the tufting machine 10. Although the motor 40 may comprise any suitable motor, the motor 40 preferably comprises a 3 hp 1800 RPM vector drive motor manufactured by Marathon Electric, Inc., of Wausau, Wis.

As shown in FIG. 2, the tufting machine 10 also includes an encoder 39 coupled to a pulley 37 through a belt 38. The pulley 37 rotates about the same shaft as pulley 34 which is used by the gearbox 36 to drive the exit pin roller 18. The encoder 39 therefore rotates in synchronism with the exit pin roller 18 and generates a pulse with each fraction of a rotation of the encoder 39. The stream of pulses generated by the encoder 39, as will be described in further detail below, is proportional to the speed of the exit pin roller 18 and may be used to control the speed of the entry pin roller 16 and, more significantly, the amount of tension in the primary backing material 14.

Figure 3:
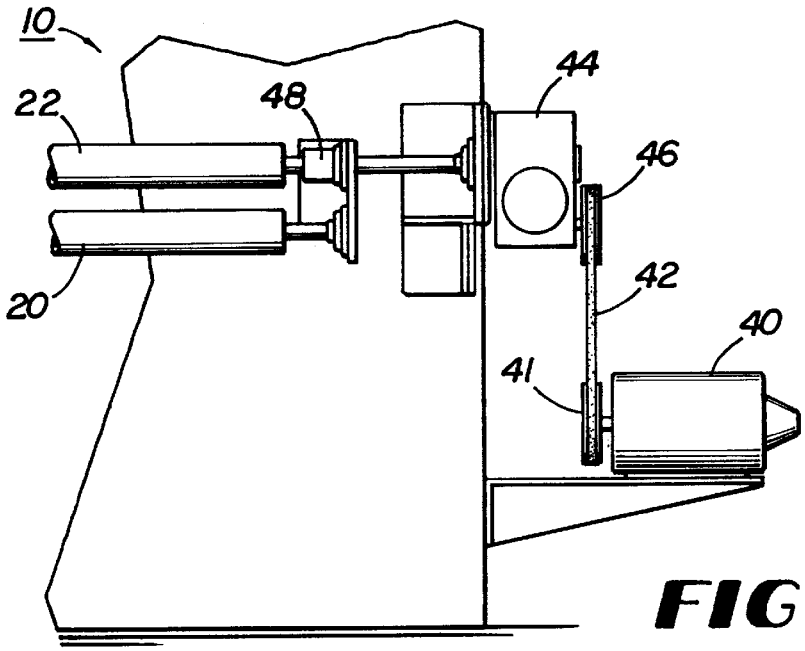
FIG. 3 is a front view of the tufting machine of FIG. 1 illustrating a load cell mounted on a load cell roller.

As best seen in FIG. 3, the load cell roller 22 has load cells 48 mounted at both of its ends, although only one is shown in the drawing. The load cells 48, which are preferably a TSF-600 load cell manufactured by Magpower Systems, Inc., measure the amount of force exerted on the load cell roller 22. Since the amount of force on the roller 22 is equal to the tension along the length of the primary backing material 14, the load cells 48 provide a measure of the amount of tension along the primary backing material 14. As will be described in more detail below, this measurement of tension in the primary backing material 14 is used along with the speed of the exit pin roller 18 to control the tension in the primary backing material 14.

Figure 4:
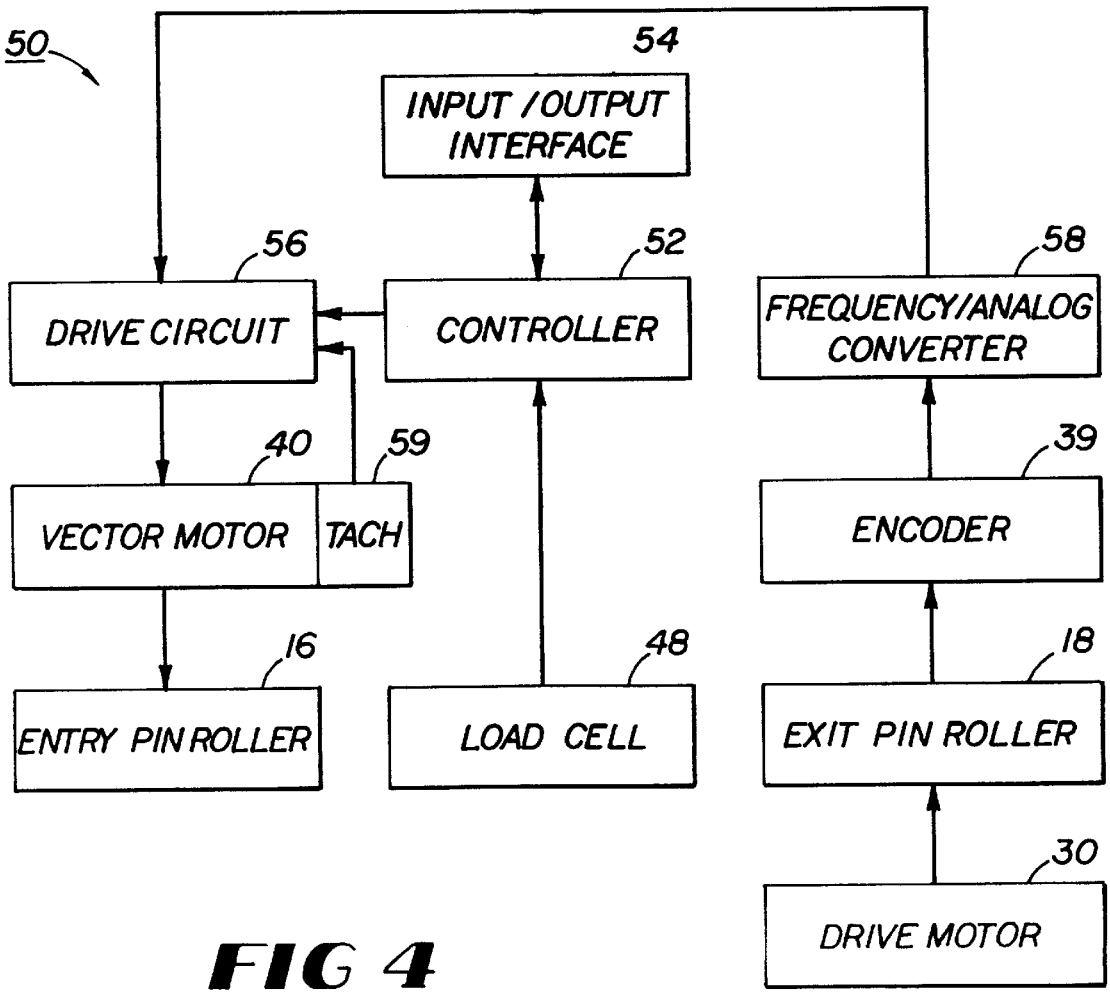
FIG. 4 is a block diagram of a system for controlling a tension across the primary backing material.

A system 50 for controlling the tension in the primary backing material 14 is shown in FIG. 4. In the system 50, the exit pin roller 18 is driven by the drive motor 30 to rotate at a certain speed with this speed being relatively constant but having some variations due to fluctuations in operation of the tufting machine 10. The encoder 39 rotates in synchronism with the exit pin roller 18 and generates a pulse with each incremental amount of rotation of the encoder 39. The pulses generated by the encoder 39 are passed to a frequency to analog converter 58 which generates an analog signal having an amplitude proportional to the frequency of the pulse stream from the encoder 39. The analog signal, which is preferably a voltage signal, therefore has an amplitude which is representative of the speed at which the exit pin roller 18 is being rotated.

The analog signal from the frequency to analog converter 58 is input to a drive circuit 56 which provides a drive signal to the vector motor 40 for controlling the speed of the motor 40. A tachometer 59, which is integral with the motor 40 in the preferred embodiment, provides feedback to a feed back circuit in the drive circuit 56 to ensure that the motor 40 is being driven at the speed indicated by the drive signal. The feed back circuit is preferably a PGX-2 feed back card that converts a frequency of the signal from the tachometer 59 into an analog signal. The desired speed of rotation for the motor 40 is determined by the drive circuit 56, in part, by the current speed at which the exit pin roller 18 is being rotated. The drive circuit 56 ensures that the entry pin roller 16 is driven slightly slower than the exit pin roller 18 so that some tension is produced in the primary backing material 14 between the entry pin roller 16 and the exit pin roller 18. Preferably, the drive circuit 56, which is a 3 hp vector drive circuit, and the feed back circuit are both manufactured by Saftronics, Inc. of Fort Myers, Fla.

The exact amount of speed differential between the entry pin roller 16 and the exit pin roller 18 is also determined, in part, through a controller 52. A user-defined desired amount of tension may be entered through an input/output interface 54, such as a keypad interface, connected to the controller 52. The controller 52 receives the outputs from the load cells 48 and may provide a display of the measured tension at the input/output interface 54, such as on a liquid crystal display (LCD). The controller 52 compares the user-defined desired amount of tension with the amount of tension measured by the load cells 48 and provides a control signal to correct any difference between the two values of tension. The controller 52 is preferably a Digitrac-P controller manufactured by Magpower Systems, Inc., of Fenton, Mo. The controller 52 preferably generates the control signal based on a proportional integral on the difference between the two values of tension. The control signal from the controller 52 is combined with the signal from the tachometer 59 and the signal from the frequency to analog converter 58 to drive the motor 40 at the speed where the value of tension measured by the load cells 48 becomes substantially equal to the user-defined desired value of tension.

With the system 50, the tufting machine 10 can accurately maintain tension in the primary backing material 14 at the user-defined desired level. Furthermore, the system 50 maintains the tension in the primary backing material 14 despite continual changes in the mass of primary backing material 14 on the roll 12 and can therefore maintain a consistent level of tension throughout the entire operation of the tufting machine 10. As a result of the constant level of tension in the primary backing material 14, the carpet produced by the tufting machine 10 does not have any significant variations in stitch density. The tufting machine 10 can therefore produce a high quality carpet with significant savings in yarn costs. With an essentially constant stitch density and constant tension, the resultant carpet produced by tufting machine 10 also minimizes any variations in patterns along the length of the primary backing material 14 and thus essentially eliminates problems with pattern staggering.

Some of the advantages of the tufting machine 10 over conventional tufting machines are especially significant in the production of patterned carpet. Differences in pattern variations are magnified when sections from different locations along the length of the primary backing material are positioned next to each other. The tufting machine 10, however, can maintain the tension along the length of the primary backing material 14 at a level, preferably a low level such as at 60 lb, which prevents the primary backing material from becoming deformed. Furthermore, the tufting machine 10 helps to ensure that the pattern of the carpet remains constant throughout production whereby pattern stagger would not be apparent between adjacent sections.

The forgoing description of the preferred embodiment of the invention has been presented only for the purpose of illustration and description and is not intended to be exhaustive or to limit the invention to the precise form disclosed. Many modifications and variations are possible in light of the above teaching.

For example, the system 50 is not limited to the specific examples of the controller 52, motor 40, and other preferred structure but may be formed with any suitable components. The predefined value of tension need not be entered into the controller 52 but may be a default value of tension that is stored within the controller 52 or a value of tension automatically determined by the controller 52. The controller 52 can generate the control signal in various ways other than with a proportional integral relationship using the difference in the actual and desired values of tension, such as by using a proportional integral differential relationship using the difference in tension values.

Further, while the system 50 controls tension by adjusting the speed of the entry pin roller 16 relative to the speed of the exit pin roller 18, the system 50 may alternatively adjust the speed of the exit pin roller 18 relative to the speed of the entry pin roller 16. Also, rather than adjusting the speed of the entry pin roller 16 and exit pin roller 18, the system 50 may operate to adjust the relative positions of the entry pin roller 16 and the exit pin roller 18. To control the positions of the entry pin roller 16 and the exit pin roller 18, the system 50 may employ a servo motor rather than vector motor 40 and may place resolvers on both the entry pin roller 16 and the exit pin roller 18 to track the positions of the entry pin roller 16 and the exit pin roller 18.

Moreover, rather than relying solely on the entry pin roller 16 and exit pin roller 18 to advance the primary backing material 14 through the tufting machine 10, the system 50 may include additional measures in moving the primary backing material 14. For instance, the system 50 may include a motor or other drive mechanism coupled to the roll 12 to rotate the roll 12 during operation of the tufting machine 10. This motor or other drive mechanism can be controlled to provide assistance to the advancement of the backing material 14 when the tension is too high and to provide resistance to the advancement when the tension is too low and may be used in addition to, or instead of, the separate motor 40 for the entry pin roller 16.

Also, the tufting machine 10 according to the preferred embodiment of the invention includes a separate load cell roller 22 for mounting the load cells 48. The tufting machine 10, however, need not add a separate roller 22 to a tufting machine just for the load cells 48 but may have the load cells 48 mounted to a different roller, such as to the entry pin roller 16 or to any other existing roller.

Although the invention has been described with reference to a tufting machine 10 that is used in the production of carpet tiles, the invention may be equipped on any type of tufting machine, such as a broadloom tufting machine. Also, while the controller 52 has been shown as being separate from the drive circuit 56 and frequency to analog converter 58, it should be understood that the controller 52 may be combined with either or both of the drive circuit 56 and converter 58.

The embodiment was chosen and described in order to explain the principles of the invention and their practical application so as to enable others skilled in the art to utilize the invention and various embodiments and with various modifications as are suited to the particular use contemplated. It is intended that the scope of the invention only be limited by the claims appended hereto.

What is claimed is:

1. A tufting machine for inserting yarn in a backing material, comprising:

a pair of advancing rollers with a first advancing roller for feeding the backing material into the tufting machine and a second advancing roller for removing the backing material from the tufting machine;

a load measuring unit for measuring an actual value of tension generated along the backing material between the pair of advancing rollers and for generating a tension signal representing the actual value of tension;

a drive motor for rotating one advancing roller of the pair of advancing rollers;

a drive circuit for generating a driving signal for driving the drive motor;

a monitoring unit for monitoring a condition of the other advancing roller of the pair of advancing rollers and for generating a condition signal; and a controller for receiving the tension signal from the load measuring unit and for receiving a predefined value of tension, the controller generating a control signal based on the tension signal from the load measuring unit and the predefined value of tension;

wherein the drive circuit generates the driving signal by combining the condition signal from the monitoring unit and the control signal from the controller, the driving signal for causing the drive motor to rotate the one advancing roller so that the actual value of tension measured by the load measuring unit becomes substantially equal to the predefined value of tension; and wherein the monitoring unit includes an encoder coupled to the other advancing roller and a frequency to analog converter for converting an output of the encoder to an analog signal that represents a speed of the other advancing roller.

2. The tufting machine as set forth in claim 1, wherein the pair of advancing rollers comprises an entry pin roller and an exit pin roller.

3. The tufting machine as set forth in claim 1, wherein the load measuring unit comprises a load cell.

4. The tufting machine as set forth in claim 3, wherein the load cell is positioned at an entrance to the tufting machine.

5. The tufting machine as set forth in claim 1, wherein the drive motor drives the first advancing roller.

6. The tufting machine as set forth in claim 1, wherein the drive motor controls a speed of rotation of the one advancing roller.

7. The tufting machine as set forth in claim 1, wherein the monitoring unit detects the condition of speed of the other advancing roller.

8. The tufting machine as set forth in claim 1, wherein the controller generates the control signal based on a difference between the output from the load measuring unit and the predefined value of tension.

9. The tufting machine as set forth in claim 1, wherein the controller includes an input interface for receiving the predefined value of tension.

10. The tufting machine as set forth in claim 1, wherein the controller includes a output interface for displaying the actual value of tension on the backing material.

11. An apparatus for controlling a machine-direction tension in an advancing web of carpet primary backing material passing through a tufting machine, comprising:

means for advancing the web of carpet primary backing material through the tufting machine;

means for measuring the machine-direction tension in the advancing web of carpet primary backing material; and means for controlling the advancing means so that the measured machine-direction tension remains substantially equal to a predetermined quantity of tension as the web of carpet backing material is being advanced through the tufting machine;

wherein the advancing means comprises a first pin roller driven by a first drive motor for introducing the web of carpet backing material into the tufting machine and a second pin roller driven by a second drive motor for removing the web of carpet backing material from the tuffing machine; and wherein the controlling means comprises:

an encoder for tracking a rotation of the second pin roller;

a frequency to analog converter for receiving an output from the encoder and for generating an analog speed signal representative of a speed of rotation of the second pin roller;

a controller for generating a control signal based on a comparison between the measured machine-direction tension from the measuring means and the predetermined quantity of tension; and a drive circuit for generating a drive signal for driving the first drive motor, the drive circuit producing the drive signal based on a combination of the analog speed signal from the frequency to analog converter and the control signal from the controller.

12. The apparatus as set forth in claim 11, wherein the controlling means controls one of the first drive motor or second drive motor so that the web of carpet backing material has the predetermined quantity of tension.

13. The apparatus as set forth in claim 11, wherein the measuring means comprises a load cell for measuring the machine-direction tension in the web of carpet backing material.

14. The apparatus as set forth in claim 11, wherein the controlling means controls the advancing means so that a first speed at which the web of carpet backing material is introduced into the tufting machine is slower than a second speed at which the web of carpet backing material is removed from the tufting machine.

* * * * *

UNITED STATES PATENT AND TRADEMARK OFFICE

CERTIFICATE OF CORRRECTION

PATENT NO. : 5,809,917
DATED : Sept. 22, 1998
INVENTOR(S) : MCGOWAN, et al.

It is certified that error appears in the above-identified patent and that said Letters Patent is hereby corrected as shown below:

On the title page, in item [56] References Cited, insert the following:

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 5 | 5 | 8 | 8 | 3 | 8 | 3 | 12/31/96 | Davis et al. | | | |
| | | 2 | 8 | 5 | 7 | 8 | 6 | 7 | 10/28/58 | Beasley | | | |
| | | 4 | 2 | 3 | 7 | 8 | 0 | 2 | 12/09/80 | Scott | | | |
| | | | | | | | | | | | | | |

UNITED STATES PATENT AND TRADEMARK OFFICE

CERTIFICATE OF CORRRECTION

PATENT NO. : 5,809,917
DATED : Sept. 22, 1998
INVENTOR(S) : MCGOWAN, et al.

It is certified that error appears in the above-identified patent and that said Letters Patent is hereby corrected as shown below:

FOREIGN PATENT DOCUMENTS

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | | DE | 36 | 05 | 1 | 6 | 8 | A1 | 8/28/86 | Germany | | | | |
| | | 9 | 2 | 9 | 9 | 2 | 8 | | 6/26/63 | French | | | | |
| | | | | | | | | | | | | | | |

UNITED STATES PATENT AND TRADEMARK OFFICE

CERTIFICATE OF CORRRECTION

PATENT NO. : 5,809,917
DATED : Sept. 22, 1998
INVENTOR(S) : MCGOWAN, et al.

It is certified that error appears in the above-identified patent and that said Letters Patent is hereby corrected as shown below:

OTHER DOCUMENTS

| | | |
|---|---|---|
| | | PCT/US98/00812 International Search Report, European Patent Office (May 12, 1998) |
| | | |

Signed and Sealed this

Thirteenth Day of April, 1999

*Attest:*

Q. TODD DICKINSON

*Attesting Officer*

*Acting Commissioner of Patents and Trademarks*